US005558247A

United States Patent [19]

Caso

[11] Patent Number: 5,558,247

[45] Date of Patent: Sep. 24, 1996

[54] EXTENSION TUBE CLIP HOLDER

[76] Inventor: Frank J. Caso, 11 Victor Ave., Eatontown, N.J. 07724

[21] Appl. No.: 292,210

[22] Filed: Aug. 19, 1994

[51] Int. Cl.[6] ..... A47G 29/00

[52] U.S. Cl. ..... 220/735; 248/110; 248/316.7

[58] Field of Search ..... 220/735, 710, 220/705; 248/65, 68.1, 110, 213.2, 231.8, 316.7

[56] References Cited

U.S. PATENT DOCUMENTS

| | | | |
|---|---|---|---|
| 390,089 | 9/1888 | McClelland | 220/735 X |
| 2,979,554 | 4/1961 | Maitland | 248/316.7 X |
| 3,450,313 | 7/1967 | Jonas . | |
| 4,141,445 | 2/1979 | Korich | 220/735 X |
| 4,646,999 | 3/1987 | Clark | 248/110 X |
| 4,928,859 | 5/1990 | Krahn et al. . | |
| 5,178,354 | 6/1993 | Engvall . | |
| 5,193,748 | 3/1993 | Wittersheim et al. . | |
| 5,211,335 | 5/1993 | Strid . | |
| 5,236,106 | 8/1993 | Laska . | |
| 5,269,614 | 12/1993 | Taylor . | |

OTHER PUBLICATIONS

Photograph showing cap structures on cans of CRC 5–56 Lubricant; CRC QD QD Electronic Cleaner; and Valvtect Marine Motor Tune–Up.

*Primary Examiner*—Steven M. Pollard

*Attorney, Agent, or Firm*—Lerner, David, Littenberg, Krumholz & Mentlik

[57] ABSTRACT

A holder for securing an extension tube to a side of an aerosol container. The inventive device includes a center member having a slot for receiving the extension tube. A pair of arcuate arms extend from the center member and can be resiliently positioned about the container to secure the center member and associated extension tube thereto.

1 Claim, 4 Drawing Sheets

FIG 3
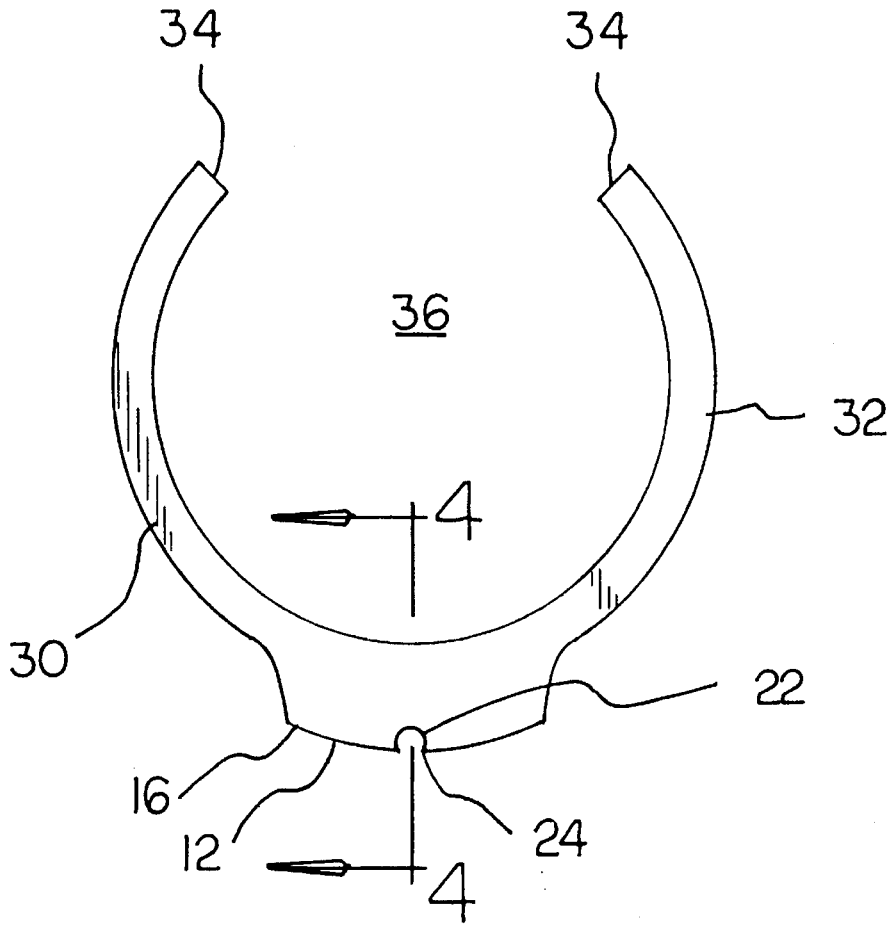
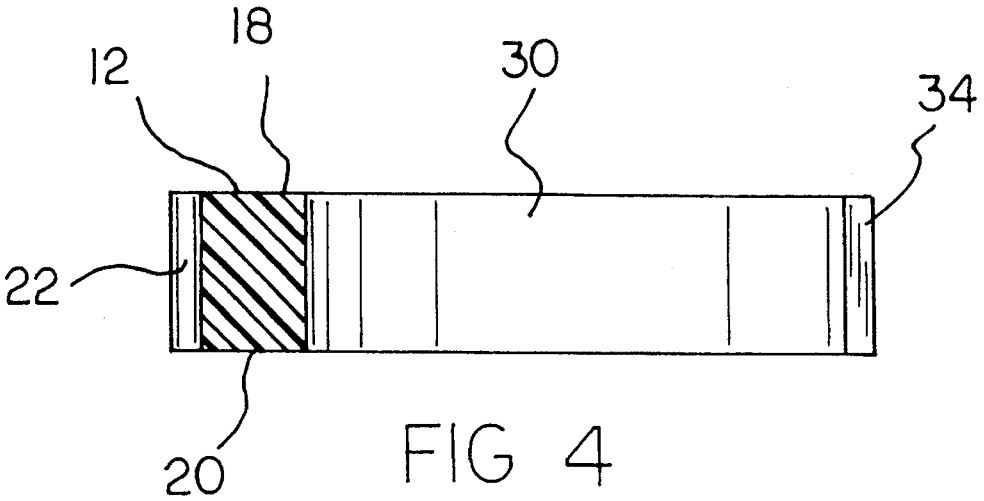
FIG 4

FIG 7
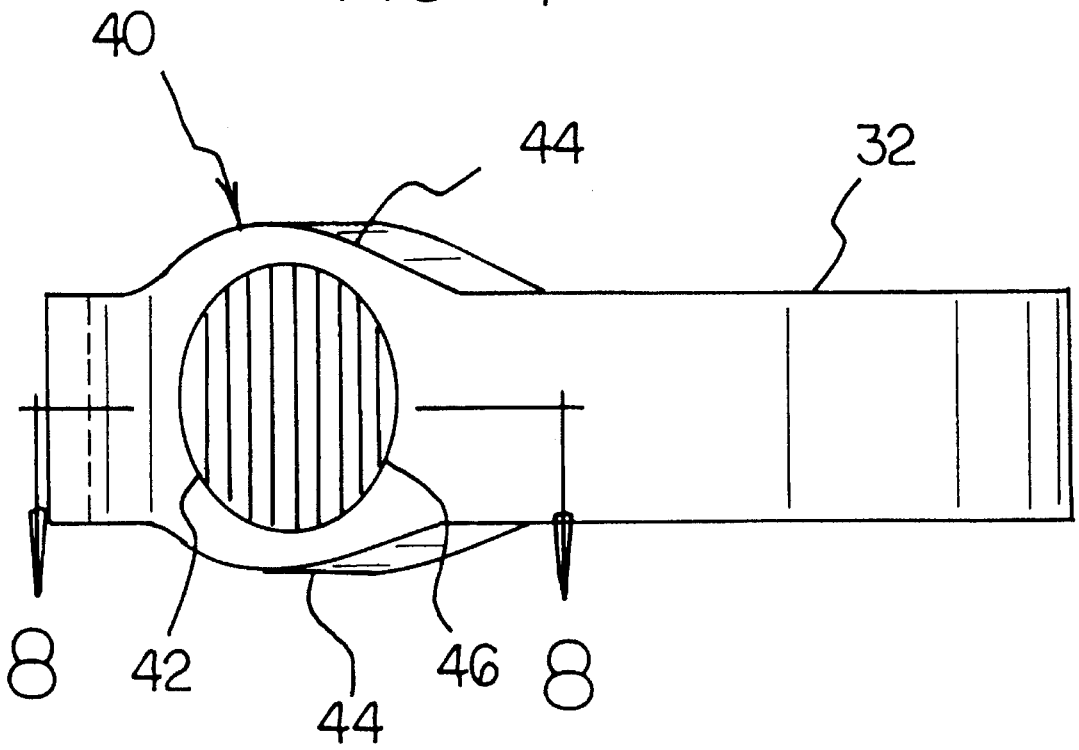
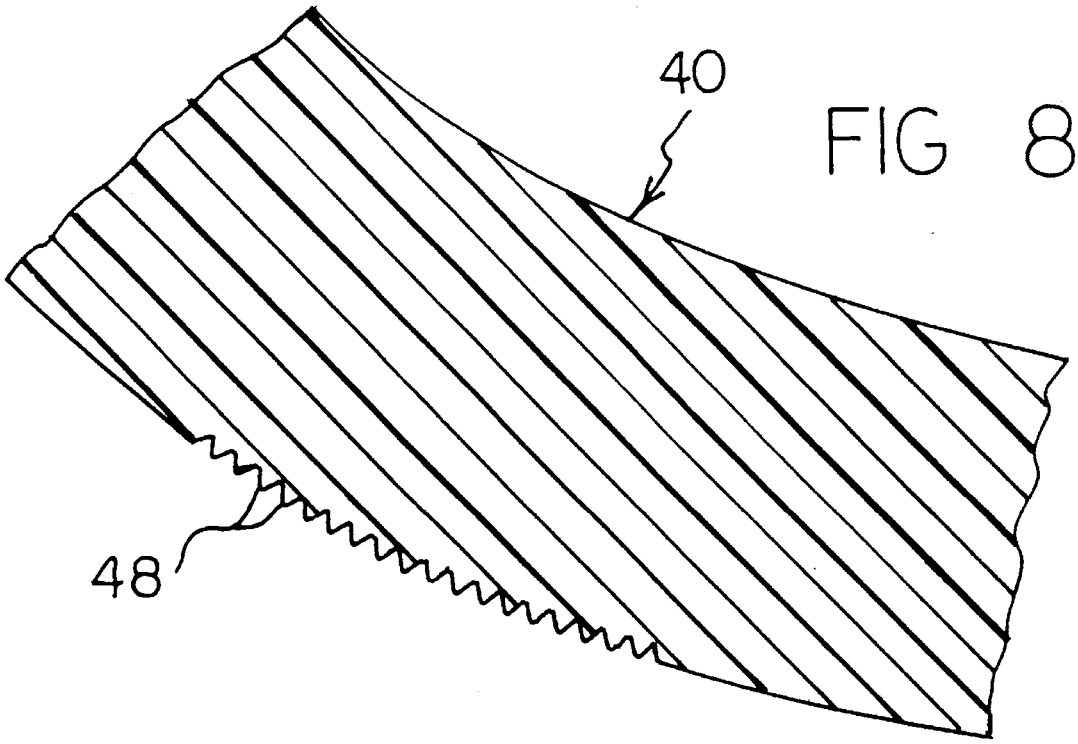
FIG 8

EXTENSION TUBE CLIP HOLDER

BACKGROUND OF THE INVENTION

1. Field of the Invention

The present invention relates to clip structures and more particularly pertains to an extension tube clip holder for securing an extension tube to a side of an aerosol container.

2. Description of the Prior Art

The use of clip structures is known in the prior art. More specifically, clip structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art clip structures include U.S. Pat. Nos. 5,269,614; 5,236,106; 5,211,335; 5,193,748; and 3,450,313.

While these devices fulfill their respective, particular objectives and requirements, the aforementioned patents do not disclose an extension tube clip holder for securing an extension tube to a side of an aerosol container which includes a center member having a slot for receiving the extension tube, and a pair of arcuate arms extending from the center member and positionable about the container to secure the center member and associated extension tube to the container.

In these respects, the extension tube clip holder according to the present invention substantially departs from the conventional concepts and designs of the prior art, and in so doing provides an apparatus primarily developed for the purpose of securing an extension tube to a side of an aerosol container.

SUMMARY OF THE INVENTION

In view of the foregoing disadvantages inherent in the known types of clip structures now present in the prior art, the present invention provides a new extension tube clip holder construction wherein the same can be utilized for securing an extension tube to the side of an aerosol container. As such, the general purpose of the present invention, which will be described subsequently in greater detail, is to provide a new extension tube clip holder apparatus and method which has many of the advantages of the clip structures mentioned heretofore and many novel features that result in a extension tube clip holder which is not anticipated, rendered obvious, suggested, or even implied by any of the prior art clip structures, either alone or in any combination thereof.

To attain this, the present invention generally comprises a holder for securing an extension tube to a side of an aerosol container. The inventive device includes a center member having a slot for receiving the extension tube. A pair of arcuate arms extend from the center member and can be resiliently positioned about the container to secure the center member and associated extension tube thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new extension tube clip holder apparatus and method which has many of the advantages of the clip structures mentioned heretofore and many novel features that result in a extension tube clip holder which is not anticipated, rendered obvious, suggested, or even implied by any of the prior art clip structures, either alone or in any combination thereof.

It is another object of the present invention to provide a new extension tube clip holder which may be easily and efficiently manufactured and marketed.

It is a further object of the present invention to provide a new extension tube clip holder which is of a durable and reliable construction.

An even further object of the present invention is to provide a new extension tube clip holder which is susceptible of a low cost of manufacture with regard to both materials and labor, and which accordingly is then susceptible of low prices of sale to the consuming public, thereby making such extension tube clip holders economically available to the buying public.

Still yet another object of the present invention is to provide a new extension tube clip holder which provides in the apparatuses and methods of the prior art some of the advantages thereof, while simultaneously overcoming some of the disadvantages normally associated therewith.

Still another object of the present invention is to provide a new extension tube clip holder for securing an extension tube to a side of an aerosol container.

Yet another object of the present invention is to provide a new extension tube clip holder which includes a center member having a slot for receiving the extension tube, and a pair of arcuate arms extending from the center member and positionable about the container to secure the center member and associated extension tube to the container.

Even still another object of the present invention is to provide a new extension tube clip holder which further includes gripping means for facilitating a resilient biasing of the arcuate arms about the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view thereof.

FIG. 4 is a cross sectional view taken along line 4—4 of FIG. 3.

FIG. 7 is a side elevation view of the invention including the gripping means.

FIG. 8 is a cross sectional view taken along line 8—8 of FIG. 7.

DESCRIPTION OF THE PREFERRED EMBODIMENT

Figure 1:
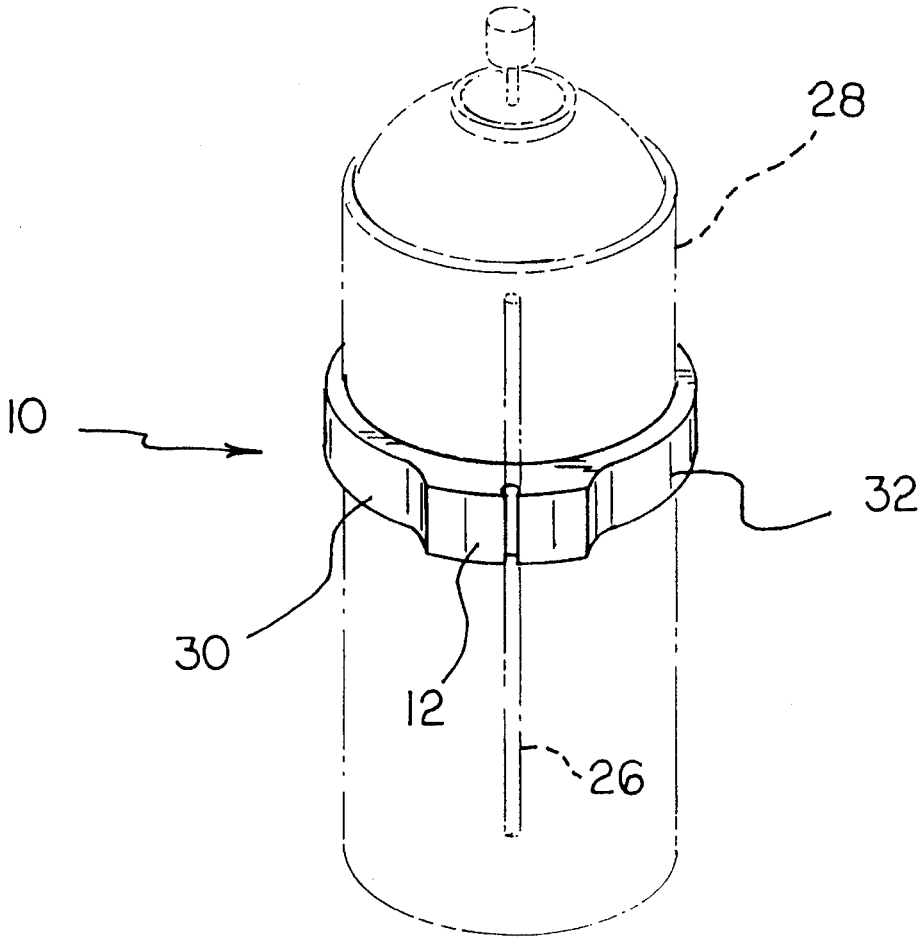
FIG. 1 is an isometric illustration the extension tube clip holder according to the present invention as installed on a container.

With reference now to the drawings, and in particular to FIGS. 1–8 thereof, a new extension tube clip holder embodying the principles and concepts of the present invention and generally designated by the reference numeral 10 will be described.

More specifically, it will be noted that the extension tube clip holder 10 comprises a substantially rectangular center member 12 having an arcuate inner wall 14 and an arcuate exterior wall 16 with opposed top and bottom walls 18, 20 orthogonally extending between the inner and exterior walls, as best illustrated in the plan view of FIG. 3. The center member 12 includes a vertically extending circular aperture 22 which extends from the top wall 18 to the bottom wall 20 proximal to the arcuate exterior wall 16. An opening 24 extends through the exterior wall 16 and is coextensive with the circular aperture 22 to permit communication with the circular aperture not only through the ends thereof located at the top and bottom walls 18, 20, respectively, but also through the exterior wall 16. By this structure, an extension tube 26 can be positioned within the circular aperture 22 by either a longitudinal positioning of the extension tube through the aperture 22 from either the top wall 18 or the bottom wall 22, or alternatively, by a lateral positioning of the extension tube through the opening 24, whereby the extension tube will snap into the circular aperture 22. The circular aperture 22 is sized so as to create a frictional engagement with the extension tube 26 which precludes unintentional removal of the extension tube therefrom.

Figure 2:
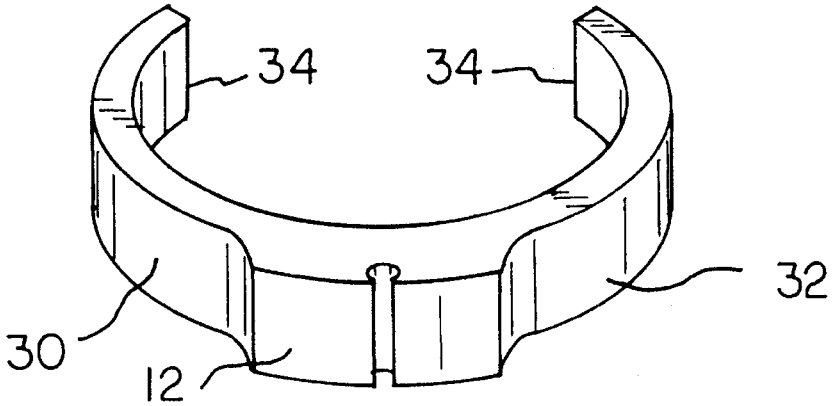
FIG. 2 is an isometric illustration of the present invention.

To retain the center member 12 along a side wall of a container 28, as illustrated in FIG. 1, a first arcuate arm 30 and a second arcuate arm 32 extend from the center member and at least partially around the cylindrical side wall of the container. As best illustrated in FIGS. 2 and 3, the arcuate arms 30, 32 are substantially similar in shape and extend from laterally opposed sides of the center member 12 to terminate in a pair of spaced distal ends 34. The arcuate arms 30, 32 cooperate with the arcuate inner wall 14 to define a substantially circular area 36 within which the container 28 may reside. Because the distal ends 34 of the arcuate arms 30, 32 are spaced a predetermined distance apart, the container 28 may be positioned into the center area 36 by positioning the distal ends 34 against the side wall of the container, whereby the resilient nature of the arcuate arms permits the same to be biased laterally outward to permit entrance of the container 28 into the center area 36. Preferably, the entire device 10 is comprised of a substantially resilient plastic material or the like which permits such resilient deformation thereof.

Figure 5:
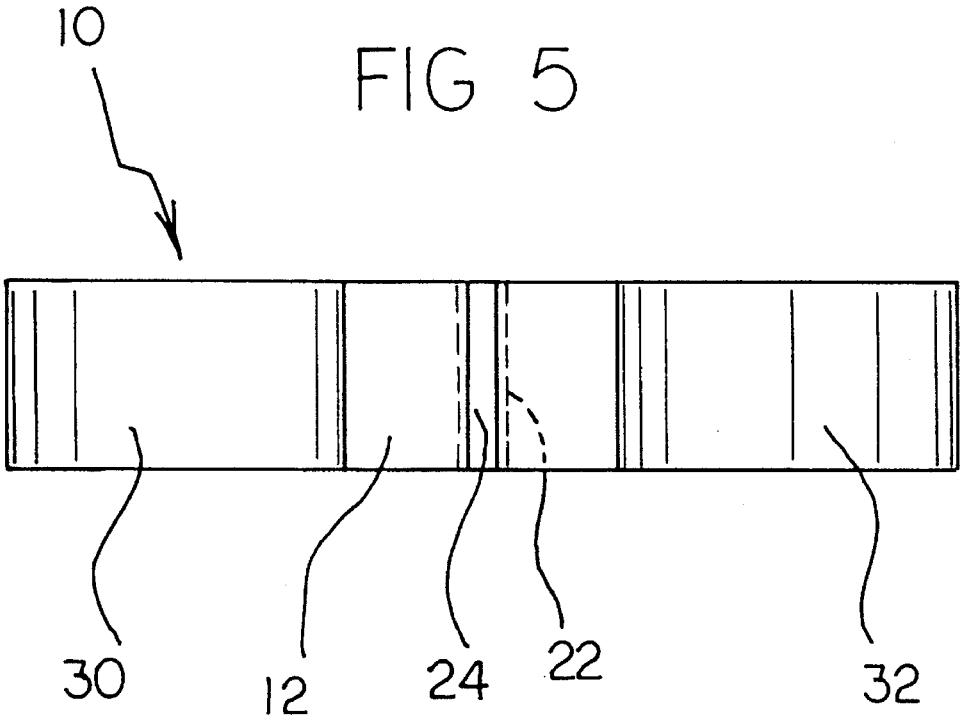
FIG. 5 is a front elevation view of the invention.

Referring now to FIG. 5, it can be shown that the opening 24 which permits lateral entrance of the extension tube 26 into the circular aperture 22 has an opening lateral width, with the circular aperture 22 having a circular aperture diameter, wherein the circular aperture diameter is substantially larger than the opening lateral width. By forming the opening 24 slightly smaller than the circular aperture diameter 22, the extension tube 26 is more securely retained within the aperture.

Figure 6:
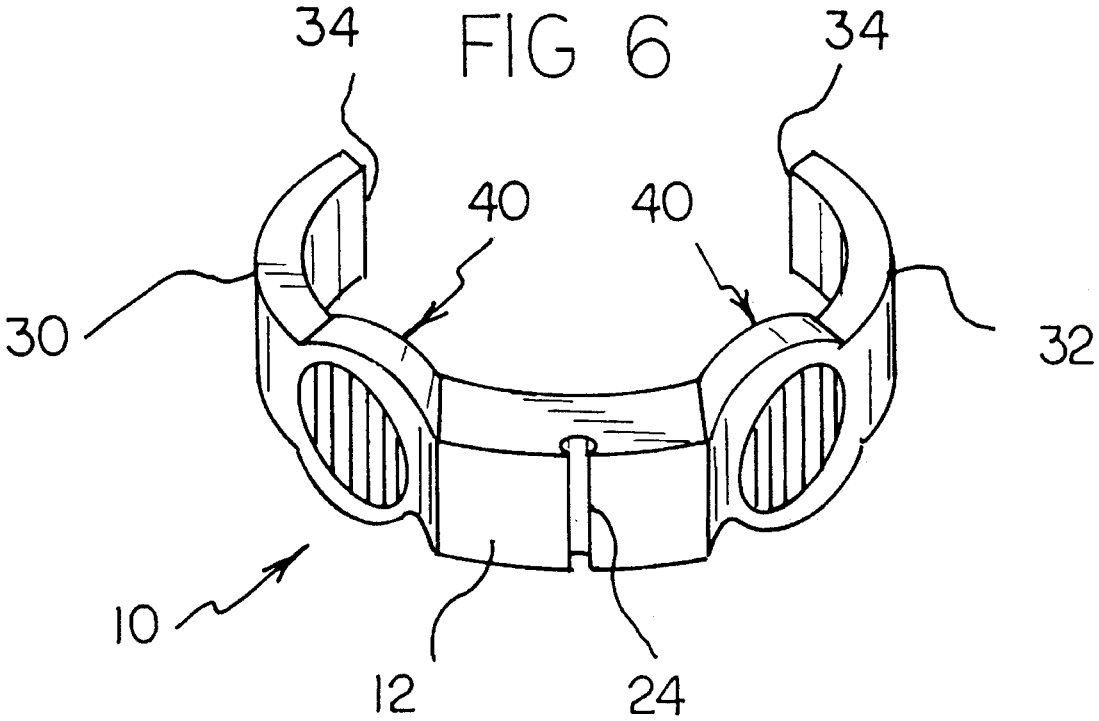
FIG. 6 is an isometric illustration of the extension tube clip holder including a gripping means.

Referring now to FIGS. 6 through 8, it can be shown that the present invention 10 may advantageously include at least one, and preferably a pair of gripping means 40 for assisting in a manual biasing of the distal ends 34 away from each other. To this end, the gripping means 40 preferably comprises a pair of gripping members 42 interposed between the laterally opposed sides of the center member 32 and the first and second arcuate arms 30, 32. Each of the gripping members 42 preferably includes arcuate extensions 44 extending vertically therefrom to increase an overall surface area of the gripping member 42. The arcuate extensions 44 preferably extend a distance sufficient to accommodate a digit of the human hand comfortably thereon. To preclude slippage of an individual's finger or thumb across the gripping means 40, a gripping surface 46 is integrally formed along an outer exterior surface of the gripping member 42. The gripping surface 46 preferably comprises a plurality of gripping serrations 48 molded into the gripping member 42. By this structure, an individual may grasp the device 10 by positioning the index finger of the left hand onto the distal end 34 of the first arcuate arm 30 and a thumb of the left hand onto the gripping means 40 interposed between the center member 12 and the first arcuate arm. Further, the index finger of the individual's right hand can be positioned into engagement with the distal end 34 of the second arcuate arm 32, with the right thumb of the individual being positioned onto the gripping means 40 interposed between the center member 12 and the second arcuate arm. In this configuration, the distal ends 34 of the first and second arcuate arms 30, 32 may be resiliently biased apart during an installation procedure of the device 10 about the container 28.

In use, the extension tube clip holder 10 provides a convenient means for storing the extension tubes 26 commonly provided with aerosol containers 28, as shown in FIG. 1. Commonly, these extension tubes 26 are easily misplaced or lost. However, such occurrences of loss of the extension tubes 26 are greatly reduced through a use of the present invention 10 as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An extension tube clip holder comprising:

a center member having an arcuate inner wall and an outer wall with a circular aperture extending through said center member and parallel to said outer wall, said center member further having an opening which extends through said outer wall and is coextensive with said circular aperture to permit communication with said circular aperture through said outer wall, said circular aperture and said opening being so constructed and arranged that an extension tube can be inserted into said circular aperture for secure storage and can be easily removed therefrom for use;

a first arcuate arm extending from a first side of said center member;

a second arcuate arm extending from a second side of said center member, said arms terminating in a pair of spaced distal ends, said arcuate arms cooperating with said inner wall to define a substantially circular area within which a container is positionable such that said arms extend at least partially around a cylindrical side wall of a container to secure said center member to a container; and a first gripping member interposed between said first side of said center member and said first arcuate arms, and a second gripping member interposed between said second side of said center member and said second arcuate arms, each of said gripping members including arcuate extensions extending vertically therefrom and a gripping surface extending along said outer exterior surface of said gripping member, said gripping surface comprising a plurality of gripping serrations integrally molded into said gripping member, whereby an individual can grasp said holder by positioning a left index finger onto said distal end of said first arcuate arm and a left thumb onto said first gripping member and by positioning a right index finger into engagement with said distal end of said second arcuate arm and a right thumb onto said second gripping member, whereby said distal ends of said first and second arcuate arms can be resiliently biased apart during installation procedure of the holder.

* * * * *